US010399204B2

(12) United States Patent
Liu et al.

(10) Patent No.: US 10,399,204 B2
(45) Date of Patent: Sep. 3, 2019

(54) WHEEL BLANK POSITIONING END FACE CORRECTION DEVICE

(71) Applicant: CITIC Dicastal CO., LTD, Qinhuangdao (CN)

(72) Inventors: Huiying Liu, Qinhuangdao (CN); Weidong Liu, Qinhuangdao (CN); Bowen Xue, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 177 days.

(21) Appl. No.: 15/801,952

(22) Filed: Nov. 2, 2017

(65) Prior Publication Data

US 2019/0022822 A1 Jan. 24, 2019

(30) Foreign Application Priority Data

Jul. 21, 2017 (CN) ..... 2017 1 0598360

(51) Int. Cl.

| | |
|---|---|
| ***B24B 49/12*** | (2006.01) |
| ***B24B 47/22*** | (2006.01) |
| ***B24B 5/44*** | (2006.01) |
| ***B24B 9/04*** | (2006.01) |
| ***B24B 29/00*** | (2006.01) |

(52) U.S. Cl.

CPC ..... *B24B 49/12* (2013.01); *B24B 5/44* (2013.01); *B24B 9/04* (2013.01); *B24B 29/005* (2013.01); *B24B 47/22* (2013.01)

(58) Field of Classification Search

CPC .. B24B 49/12; B24B 5/44; B24B 9/04; B24B 29/005; B24B 47/22

USPC ..... 451/5, 236, 463, 398

See application file for complete search history.

(56) References Cited

U.S. PATENT DOCUMENTS

| | | | | |
|---|---|---|---|---|
| 1,256,072 A * | 2/1918 | Stevenson | E21B 7/025 173/161 |
| 2,948,087 A * | 8/1960 | Caton | B24B 7/12 15/77 |
| 3,951,563 A * | 4/1976 | Ravenhall | G01B 7/315 408/1 R |
| 4,209,948 A * | 7/1980 | Obear | B24B 7/075 451/213 |
| 5,890,952 A * | 4/1999 | Beaupre | B23Q 3/18 451/168 |
| 6,217,424 B1 * | 4/2001 | Stephens | B24B 5/44 451/254 |
| 10,272,483 B1 * | 4/2019 | Liu | B21D 53/30 |

(Continued)

*Primary Examiner* — George B Nguyen

(74) *Attorney, Agent, or Firm* — Calfee, Halter & Griswold LLP

(57) ABSTRACT

The present application disclose a wheel blank positioning end face correction device, comprising a frame, a servo motor I, a support frame, a bearing seat, a bearing, a shaft, a rotating platform, a guide rail, a cylinder, a left slide plate, a left bearing seat, a left shaft, a left bearing, a left driven grooved friction wheel, a left workbench, corner cylinder pressure claws, mandrel seats, mandrels, a grinding wheel, a grinding wheel drive motor, a support plate, a feeding slide plate, feeding guide rails, a linear motor, a distance measuring sensor, a fixed plate, a servo motor II, a driving grooved friction wheel, a right workbench, a right driven grooved friction wheel, a right shaft, a gear rack structure and a right slide plate.

3 Claims, 3 Drawing Sheets

(56) References Cited

U.S. PATENT DOCUMENTS

2001/0031614 A1* 10/2001 Morkvenas ..... B24B 7/12
451/270
2006/0042091 A1* 3/2006 Luschei ..... B23B 1/00
29/894.35

* cited by examiner

WHEEL BLANK POSITIONING END FACE CORRECTION DEVICE

CROSS-REFERENCE TO RELATED APPLICATIONS

This application claims priority to Chinese Patent Application No. 201710598360.X, filed on Jul. 21, 2017, which is hereby incorporated by reference in its entirety.

TECHNICAL FIELD

The present application relates to the technical field of deformation correction, specifically to a correction device for a wheel blank machining positioning end face.

BACKGROUND ART

Casting deformation often occurs in the aluminum alloy wheel cast molding process, and the front end face of a blank is used for axial positioning of machining, so the deformation of the wheel blank positioning end face directly determines the positioning precision. When the wheel blank positioning end face is deformed greatly, the clamping positioning precision is very low, and some positions of the inner rim, outer rim or flange of the machined wheel cannot be turned, thus directly resulting in a reject.

SUMMARY OF THE INVENTION

The present application is aimed at providing a wheel blank positioning end face correction device for correcting the front positioning end face of a wheel blank, thereby eliminating the height difference of the positioning end face, improving the positioning precision of the positioning end face and avoiding machined rejects caused by insufficient positioning precision.

In order to achieve the above object, the technical solution of the present application is: A wheel blank positioning end face correction device comprises a frame, a servo motor I, a support frame, bearing seats, bearings, a shaft, a rotating platform, a guide rail, a cylinder, a left slide plate, a left bearing seat, a left shaft, a left bearing, a left driven grooved friction wheel, a left workbench, corner cylinder pressure claws, mandrel seats, mandrels, a grinding wheel, a grinding wheel drive motor, a support plate, a feeding slide plate, feeding guide rails, a linear motor, a distance measuring sensor, a fixed plate, a servo motor II, a driving grooved friction wheel, a right workbench, a right driven grooved friction wheel, a right shaft, a gear rack structure and a right slide plate.

The servo motor I is fixed on the support frame, the output end of the servo motor I is connected with the shaft, the rotating platform is fixed on the shaft, and thus the servo motor I controls rotation of the rotating platform.

The rotating platform is provided with two stations including a correction station on the left and a detection station on the right. The guide rail is fixed on the rotating platform, the left slide plate and the right slide plate are respectively mounted on the guide rail, the left slide plate is connected with the right slide plate via the gear rack structure, the cylinder is mounted on one lateral vertical surface of one end of the rotating platform, and the output end of the cylinder is connected with the left slide plate.

The left shaft is mounted onto the left slide plate via the left bearing and the left bearing seat, the left driven grooved friction wheel is mounted on the left shaft, the left workbench is connected onto the left shaft, a mandrel seat and corner cylinder pressure claws are mounted on the left workbench, a mandrel is mounted on the mandrel seat and used for radial positioning of a wheel, and the end face of the mandrel seat achieves an axial positioning effect. The right slide plate is like the left slide plate, the right shaft is mounted onto the right slide plate via a bearing and a bearing seat, the right driven grooved friction wheel is mounted on the right shaft, the right workbench is connected onto the right shaft, a mandrel seat and corner cylinder pressure claws are mounted on the right workbench, and a mandrel is mounted on the mandrel seat. The fixed plate is fixed above the frame, the servo motor II is mounted on the fixed plate, and the output end of the servo motor II is connected with the driving grooved friction wheel.

The distance measuring sensor is mounted on the frame above the right workbench, and when a wheel blank rotates one circle, deformation of the end face of the blank can be detected via the distance measuring sensor. The distance measuring sensor and the right workbench device jointly form a detection system.

The linear motor and the support plate are mounted on the frame above the left workbench, two feeding guide rails are mounted on the support plate, the feeding slide plate is mounted on the feeding guide rails, and the output end of the linear motor is connected with the feeding slide plate. The grinding wheel drive motor is mounted below the feeding slide plate, the grinding wheel is mounted at the output end of the grinding wheel drive motor, and the grinding wheel is used for grinding and correcting the positioning end face of the wheel blank. The grinding device and the left workbench device jointly form a correction system.

The working process of the wheel blank positioning end face correction device is as follows: at the beginning, the driving grooved friction wheel is disengaged from the left driven grooved friction wheel and the right driven grooved friction wheel. Firstly, a wheel blank is mounted onto the right workbench and clamped via the corner cylinder pressure claws; then the cylinder is started, and the left driven grooved friction wheel and the right driven grooved friction wheel synchronously compress the driving grooved friction wheel under the action of the gear rack structure, so that the friction wheels are engaged; then the servo motor II drives the driving grooved friction wheel to rotate, and the left workbench and the right workbench synchronously rotate at a low speed under the action of drive of the friction wheel; the left workbench is located inside in the initial state and is not mounted with a wheel thereon, so the left workbench idles, the low-speed rotation of the right workbench drives the wheel blank to rotate at a low speed, at the moment, the distance measuring sensor begins measuring the end face deformation of the blank, the measurement is completed when the blank rotates one circle, the distance measuring sensor feeds the measured data back to the linear motor, then the driving grooved friction wheel stops rotating, and the cylinder drives the left driven grooved friction wheel and the right driven grooved friction wheel to be disengaged from the driving grooved friction wheel; then the servo motor I is started to drive the rotating platform to rotate 180 degrees, at the moment, the right workbench rotates to the inside, the end face of the blank is located below the grinding wheel, the left workbench rotates to the outside, and an operator mounts the wheel blank onto the left workbench; next, the cylinder is started, and the left driven grooved friction wheel and the right driven grooved friction wheel synchronously compress the driving grooved friction wheel under the action of the gear rack structure, so that the friction wheels are engaged; then the linear motor is started, the rotating grinding wheel is driven to be fed down in place according to a received blank deformation signal, then the servo motor II drives the driving grooved friction wheel to rotate, the left workbench and the right workbench synchronously rotate at a low speed under the action of drive of the friction wheel, the end face of the blank below the grinding wheel is grinded and corrected after they rotate one circle, and the deformation measurement of the blank below the distance measuring sensor is completed; and then the friction wheels are disengaged, the rotating platform rotates 180 degrees, the operator takes the corrected blank down and simultaneously mounts a blank to be corrected, said process is repeated, and so on.

By adopting closed-loop control of first measurement and then correction, the precision of correction is greatly improved; by setting double stations, deformation of next blank to be corrected is measured while one blank is corrected, so that the production efficiency is greatly improved; and the device is flexible in structure, stable, efficient and advanced in process.

Figure 1:
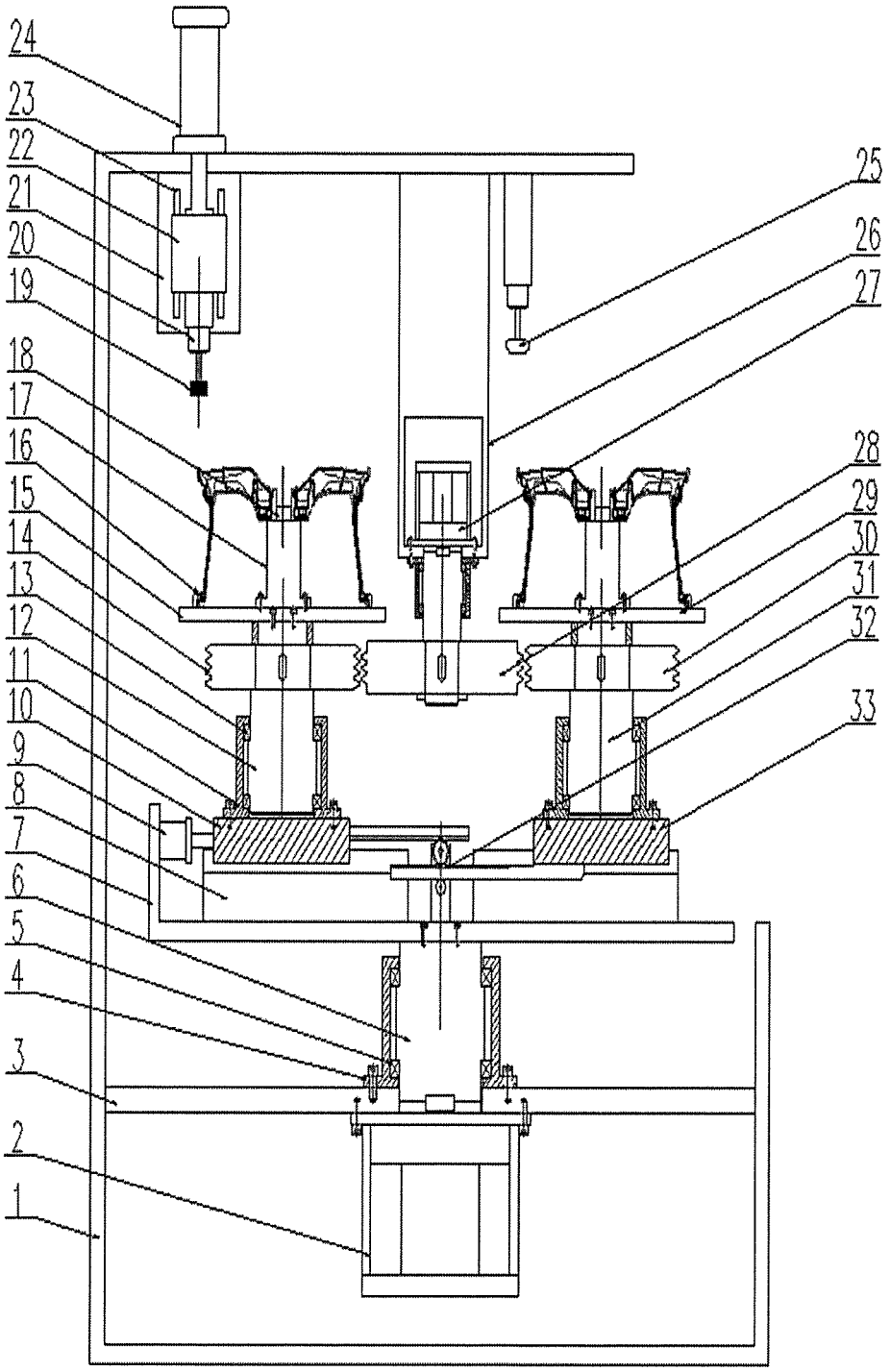
FIG. 1 is a front view of a wheel blank positioning end face correction device of the present application.
Figure 2:
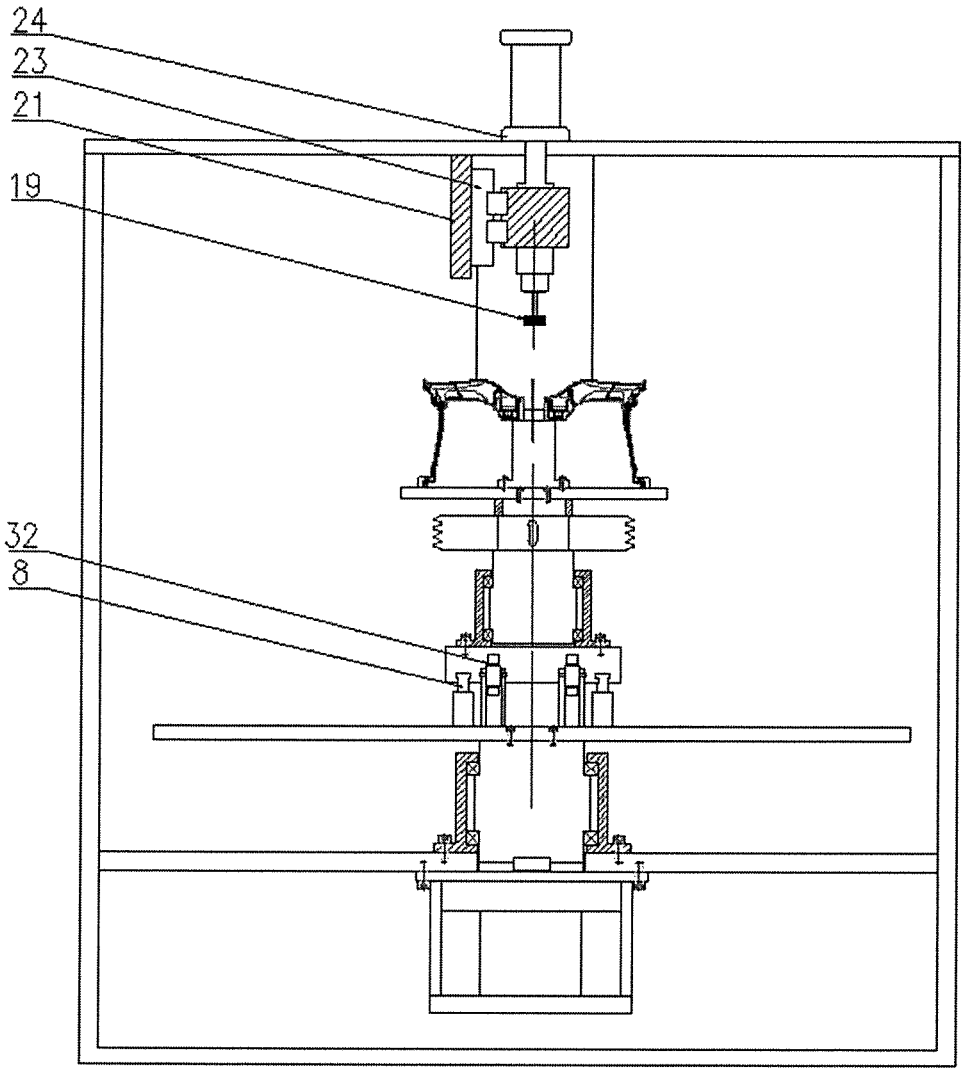
FIG. 2 is a left view of the wheel blank positioning end face correction device of the present application.
Figure 3:
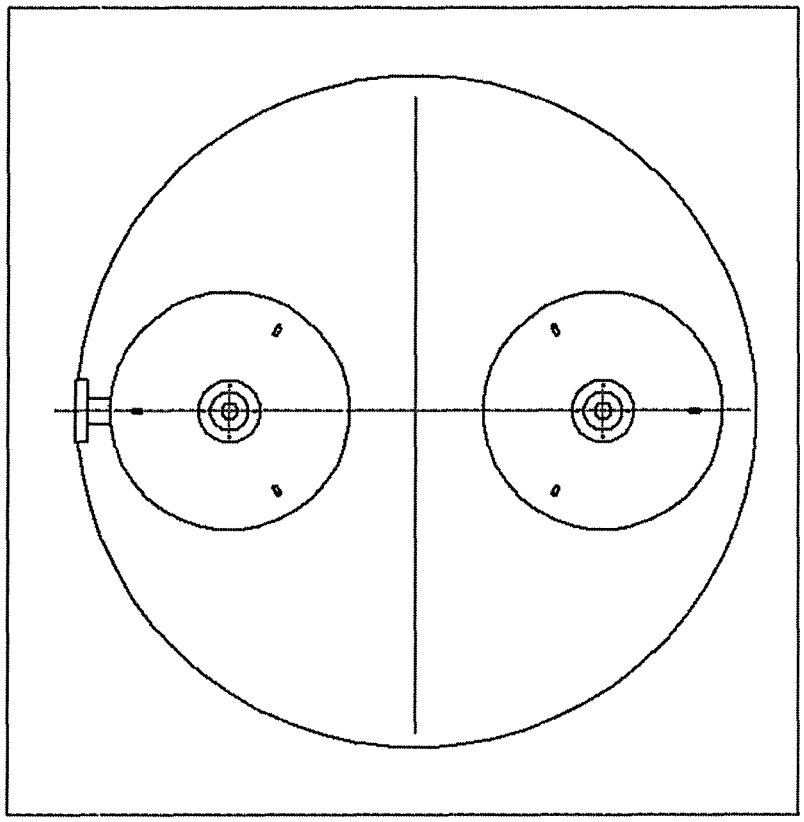
FIG. 3 is a top view of the wheel blank positioning end face correction device of the present application.

In figures: 1—frame, 2—servo motor I, 3—support frame, 4—bearing seat, 5—bearing, 6—shaft, 7—rotating platform, 8—guide rail, 9—cylinder, 10—left slide plate, 11—left bearing seat, 12—left shaft, 13—left bearing, 14—left driven grooved friction wheel, 15—left workbench, 16—corner cylinder pressure claw, 17—mandrel seat, 18—mandrel, 19—grinding wheel, 20—grinding wheel drive motor, 21—support plate, 22—feeding slide plate, 23—feeding guide rail, 24—linear motor, 25—distance measuring sensor, 26—fixed plate, 27—servo motor II, 28—driving grooved friction wheel, 29—right workbench, 30—right driven grooved friction wheel, 31—right shaft, 32—gear rack structure, 33—right slide plate.

DETAILED DESCRIPTION OF THE INVENTION

Details and working conditions of a specific device provided by the present application will be given below in combination with the accompanying drawings.

A wheel blank positioning end face correction device comprises a frame 1, a servo motor I 2, a support frame 3, bearing seats 4, bearings 5, a shaft 6, a rotating platform 7, a guide rail 8, a cylinder 9, a left slide plate 10, a left bearing seat 11, a left shaft 12, a left bearing 13, a left driven grooved friction wheel 14, a left workbench 15, corner cylinder pressure claws 16, mandrel seats 17, mandrels 18, a grinding wheel 19, a grinding wheel drive motor 20, a support plate 21, a feeding slide plate 22, feeding guide rails 23, a linear motor 24, a distance measuring sensor 25, a fixed plate 26, a servo motor II 27, a driving grooved friction wheel 28, a right workbench 29, a right driven grooved friction wheel 30, a right shaft 31, a gear rack structure 32 and a right slide plate 33.

The servo motor I 2 is fixed on the support frame 3, the output end of the servo motor I 2 is connected with the shaft 6, the rotating platform 7 is fixed on the shaft 6, and thus the servo motor I 2 controls rotation of the rotating platform 7.

The rotating platform 7 is provided with two stations including a correction station on the left and a detection station on the right. The guide rail 8 is fixed on the rotating platform 7, the left slide plate 10 and the right slide plate 33 are respectively mounted on the guide rail 8, the left slide plate 10 is connected with the right slide plate 33 via the gear rack structure 32, the cylinder 9 is mounted on one lateral vertical surface of one end of the rotating platform 7, and the output end of the cylinder 9 is connected with the left slide plate 10.

The left shaft 12 is mounted onto the left slide plate 10 via the left bearing 13 and the left bearing seat 11, the left driven grooved friction wheel 14 is mounted on the left shaft 12, the left workbench 15 is connected onto the left shaft 12, a mandrel seat 17 and corner cylinder pressure claws 16 are mounted on the left workbench 15, a mandrel 18 is mounted on the mandrel seat 17 and used for radial positioning of a wheel, and the end face of the mandrel seat 17 achieves an axial positioning effect. The right slide plate 33 is like the left slide plate 10, the right shaft 31 is mounted onto the right slide plate 33 via a bearing and a bearing seat, the right driven grooved friction wheel 30 is mounted on the right shaft 31, the right workbench 29 is connected onto the right shaft 31, a mandrel seat 17 and corner cylinder pressure claws 16 are mounted on the right workbench 29, and a mandrel 18 is mounted on the mandrel seat 17. The fixed plate 26 is fixed above the frame 1, the servo motor II 27 is mounted on the fixed plate 26, and the output end of the servo motor II 27 is connected with the driving grooved friction wheel 28.

The distance measuring sensor 25 is mounted on the frame 1 above the right workbench 29, and when a wheel blank rotates one circle, deformation of the end face of the blank can be detected via the distance measuring sensor 25. The distance measuring sensor 25 and the right workbench device jointly form a detection system.

The linear motor 24 and the support plate 21 are mounted on the frame 1 above the left workbench 15, two feeding guide rails 23 are mounted on the support plate 21, the feeding slide plate 22 is mounted on the feeding guide rails 23, and the output end of the linear motor 24 is connected with the feeding slide plate 22. The grinding wheel drive motor 20 is mounted below the feeding slide plate 22, the grinding wheel 19 is mounted at the output end of the grinding wheel drive motor 20, and the grinding wheel 19 is used for grinding and correcting the positioning end face of the wheel blank. The grinding device and the left workbench device jointly form a correction system.

The working process of the wheel blank positioning end face correction device is as follows: at the beginning, the driving grooved friction wheel 28 is disengaged from the left driven grooved friction wheel 14 and the right driven grooved friction wheel 30. First, a wheel blank is mounted onto the right workbench 29 and clamped via the corner cylinder pressure claws 16; then the cylinder 9 is started, and the left driven grooved friction wheel 14 and the right driven grooved friction wheel 30 synchronously compress the driving grooved friction wheel 28 under the action of the gear rack structure 32, so that the friction wheels are engaged; then the servo motor II 27 drives the driving grooved friction wheel 28 to rotate, and the left workbench 15 and the right workbench 29 synchronously rotate at a low speed under the action of drive of the friction wheel; the left workbench 15 is located inside in the initial state and is not mounted with a wheel thereon, so the left workbench 15 idles, the low-speed rotation of the right workbench 29 drives the wheel blank to rotate at a low speed, at the moment, the distance measuring sensor 25 begins measuring the end face deformation of the blank, the measurement is completed when the blank rotates one circle, the distance measuring sensor 25 feeds the measured data back to the linear motor 24, then the driving grooved friction wheel 28 stops rotating, and the cylinder 9 drives the left driven grooved friction wheel 14 and the right driven grooved friction wheel 30 to be disengaged from the driving grooved friction wheel 28; then the servo motor I 2 is started to drive the rotating platform 7 to rotate 180 degrees, at the moment, the right workbench 29 rotates to the inside, the end face of the blank is located below the grinding wheel 19, the left workbench 15 rotates to the outside, and an operator mounts the wheel blank onto the left workbench 15; next, the cylinder 9 is started, and the left driven grooved friction wheel 14 and the right driven grooved friction wheel 30 synchronously compress the driving grooved friction wheel 28 under the action of the gear rack structure 32, so that the friction wheels are engaged; then the linear motor 24 is started, the rotating grinding wheel 19 is driven to be fed down in place according to the received blank deformation signal, then the servo motor II 27 drives the driving grooved friction wheel 28 to rotate, the left workbench 15 and the right workbench 29 synchronously rotate at a low speed under the action of drive of the friction wheel, the end face of the blank below the grinding wheel 19 is grinded and corrected after they rotate one circle, and the deformation measurement of the blank below the distance measuring sensor 25 is completed; and then the friction wheels are disengaged, the rotating platform 7 rotates 180 degrees, the operator takes the corrected blank down and simultaneously mounts a blank to be corrected, said process is repeated, and so on.

By adopting closed-loop control of first measurement and then correction, the precision of correction is greatly improved; by setting double stations, deformation of next blank to be corrected is measured while one blank is corrected, so that the production efficiency is greatly improved; and the device is flexible in structure, stable, efficient and advanced in process.

The foregoing descriptions of specific exemplary embodiments of the present application have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present application, as well as various alternatives and modifications thereof. It is intended that the scope of the invention be defined by the Claims appended hereto and their equivalents.

What is claimed is:

1. A wheel blank positioning end face correction device, comprising a frame, a servo motor I, a support frame, bearing seats, bearings, a shaft, a rotating platform, a guide rail, a cylinder, a left slide plate, a left bearing seat, a left shaft, a left bearing, a left driven grooved friction wheel, a left workbench, corner cylinder pressure claws, mandrel seats, mandrels, a grinding wheel, a grinding wheel drive motor, a support plate, a feeding slide plate, feeding guide rails, a linear motor, a distance measuring sensor, a fixed plate, a servo motor II, a driving grooved friction wheel, a right workbench, a right driven grooved friction wheel, a right shaft, a gear rack structure and a right slide plate, wherein the rotating platform is provided with two stations comprising a correction station on the left and a detection station on the right, the guide rail is fixed on the rotating platform, the left slide plate and the right slide plate are respectively mounted on the guide rail, the left slide plate is connected with the right slide plate via the gear rack structure, the cylinder is mounted on the lateral vertical surface of one end of the rotating platform, and the output end of the cylinder is connected with the left slide plate; the left shaft is mounted onto the left slide plate via the left bearing and the left bearing seat, the left driven grooved friction wheel is mounted on the left shaft, and the left workbench is connected onto the left shaft; and the right shaft is mounted onto the right slide plate via a bearing and a bearing seat, the right driven grooved friction wheel is mounted on the right shaft, and the right workbench is connected onto the right shaft.

2. The wheel blank positioning end face correction device of claim 1, wherein the distance measuring sensor is mounted on the frame above the right workbench, and when a wheel blank rotates one circle, deformation of the end face of the blank is configured to be detected via the distance measuring sensor; and the distance measuring sensor and the right workbench device jointly form a detection system.

3. The wheel blank positioning end face correction device of claim 1, wherein the linear motor and the support plate are mounted on the frame above the left workbench, the two feeding guide rails are mounted on the support plate, the feeding slide plate is mounted on the feeding guide rails, and the output end of the linear motor is connected with the feeding slide plate; the grinding wheel drive motor is mounted below the feeding slide plate, the grinding wheel is mounted at the output end of the grinding wheel drive motor, and the grinding wheel is used for grinding and correcting the positioning end face of the wheel blank; and the grinding device and the left workbench device jointly form a correction system.

* * * * *